US005732514A

United States Patent [19]

Organ

[11] Patent Number: 5,732,514

[45] Date of Patent: Mar. 31, 1998

[54] GEODESIC PORTABLE STRUCTURE

[76] Inventor: Glenn Organ, 12906 Noch Dr., Kodiak, Ak. 99616

[21] Appl. No.: 541,795

[22] Filed: Oct. 10, 1995

[51] Int. Cl.[6] ..... E04B 1/32

[52] U.S. Cl. ..... 52/81.1; 52/80.1; 52/81.4

[58] Field of Search ..... 52/80.1, 81.1, 52/81.4, 81.5, 79.5

[56] References Cited

U.S. PATENT DOCUMENTS

| | | | |
|---|---|---|---|
| 3,058,550 | 10/1962 | Richter | 52/81.2 X |
| 3,810,336 | 5/1974 | Sadae | 52/81.1 |
| 3,881,284 | 5/1975 | Martin | 52/81.1 |
| 3,953,949 | 5/1976 | O'Sheeran | 52/82 |
| 4,092,810 | 6/1978 | Sumner | 52/81.1 |
| 4,186,533 | 2/1980 | Jensen | 52/264 X |
| 4,187,613 | 2/1980 | Ivers et al. | 52/745.07 X |
| 4,263,758 | 4/1981 | Seaich | 52/81.1 |
| 4,287,690 | 9/1981 | Berger et al. | 52/81.4 |
| 4,907,382 | 3/1990 | Schwam | 52/81.1 X |
| 5,261,194 | 11/1993 | Roberts | 52/561 X |
| 5,341,610 | 8/1994 | Moss | 52/80.1 X |
| 5,452,555 | 9/1995 | Lee | 52/81.4 X |

*Primary Examiner*—Carl D. Friedman
*Assistant Examiner*—Winnie Yip
*Attorney, Agent, or Firm*—Michael J. Tavella

[57] ABSTRACT

A portable dome structure for field use. The dome has a number of preformed panels that are bent at the proper angles to form part of a dome structure. Each panel has a series of flanges around its perimeter to allow the panels to be bolted together. The sub panels are formed into quarter sections, that be carried on the floats of a small airplane. The quarter sections can then be bolted together in the field, along with floor sections to make a complete structure. No complex flaming is required. There is also no covering that has to be placed over the framing. The preferred style of dome is elliptical, which creates more headroom without more floor space. In addition to the basic dome shape, the four quarter section can be bolted to rectangular extension pieces. These pieces can be added as desired to make the dome longer, or wider, or both. Use of these extension pieces make this structure highly versatile.

19 Claims, 13 Drawing Sheets

GEODESIC PORTABLE STRUCTURE

This invention relates to portable geodesic structures and particularly to portable geodesic structures having expansion capabilities.

BACKGROUND OF THE INVENTION

Geodesic domes have been commonplace for years. Geodesic domes have been used for homes, buildings and other permanent structures. They have also been adopted for use in camping and other outdoor activities. Thus, tents and other small portable domes are now available.

Most of these domes use a great number of framing members to create the structure of the dome. Assembling this framework is time consuming. This is particularly important for portable structures used in the field. These structures are ideally set up quickly, with a minimum of parts that must be carried on site (and may be prone to being lost). Several such portable and stationary structures have been developed. For example, U.S. Pat. No. 3,810,336 to Sadao shows a dome structure built from a framework of numerous elements that form pentagons and hexagons as part of the overall structure. The elements are connected in a pattern of great circle arcs and lesser circle arcs. U.S. Pat. No. 3,881,284 to Martin shows an ellipse domes structure. This dome uses a number of fiberglass modules that for different size hexagons and pentagons that have flanges that are bolted together. All the hexagons and pentagons are flat pieces. As such, there are many pieces that must be assembled and carried on site, making assembly time consuming and complex. The dome uses many of the preformed hexagon and pentagon shapes, making field assembly difficult for temporary type structures. U.S. Pat. No. 4,287,690 to Berger et al. shows a dome made of double triangle panels that interlock to form a dome structure. The elements for pentagons or hexagons with additional panels being used as filler elements. Finally, U.S. Pat. No. 4,092,810 to Sumner shows use of flexible scalene triangular panels that are secured together along great circle arcs formed by the overlapping edges of the panels. This dome uses no supporting structure because the inventor states that the overlapping sections reinforce the other sections.

Although all the domes above produce usable structures each has its difficulties for use in remote locations. The Sadao patent uses many frame elements that must be assembled prior to using the structure. As such, this is a labor intensive design not intended for temporary structures. The patents to Martin and Berger et al. use many preformed panels to build domes. Again, for use as temporary structures, the number of panels is excessive. A simpler geometric structure is needed to assemble portable, temporary structures-one that reduces the number of elements needed. Finally, the Sumner design, although clever, is difficult to assemble. The structure achieves stability by having the flexible elements be pulled extremely tight. As the final elements are added, the tension needed to secure them is considerable. This is not the type of structure needed for remote areas where equipment is scarce.

All the domes described above have one additional problem. Their geometry does not permit splitting the domes into quarter sections that can be extended by adding rectangular sections to the structure. They can be expanded only by using larger panels as a total structure. This limits their versatility for temporary field use.

SUMMARY OF THE INVENTION

The instant invention overcomes these difficulties. It uses a number of preformed panels that are bent at the proper angles to form part of a domed structure. Each panel has a series of flanges around its perimeter to allow the panels to be bolted together. Unlike the domes mentioned above, however, the sub panels are formed into quarter sections that form right angles at their major joints. The quarter sections are small enough to be carried on the floats of a small airplane. The quarter sections can then be bolted together in the field, along with floor sections, to make a complete structure. No complex flaming is required. There is also no covering that has to be placed over the framing. This makes assembly of the structure quick and easy as compared to other domes. Moreover, because the panels are metal, they last longer than ordinary tent material. Finally, the metal walls provide a secure enclosure that is bear and human proof. The preferred style of dome is elliptical, which creates more headroom without more floor space.

In addition to the basic dome shape, the four quarter section can be bolted to rectangular extension pieces. These pieces can be added as desired to make the dome longer, or wider, or both. Use of these extension pieces make this structure highly versatile. Unlike other domes that use frames and covers, the extension panels can be readily added. In the frame domes, such extensions can be added only after the structure has been disassembled. Moreover, the geometry of some domes makes adding such extensions difficult, if not impossible.

It is an object of this invention to produce a dome structure that requires no complex framing.

It is another object of this invention to produce a domed structure that can be easily assembled in field conditions.

It is yet another object of this invention to produce a domed structure that uses a number of formed wall and floor sections that are bolted together to form the structure.

It is another object of this invention to produce a domed structure wherein the formed wall sections can be carried on a small airplane for assembly in remote locations.

It is yet a further object of this invention to produce a domed structure that can be assembled with a few small hand tools.

It is a further object of this invention to produce a domed structure that can be expanded by adding preformed plates to the formed wall sections.

DETAILED DESCRIPTION OF THE INVENTION

Figure 1:
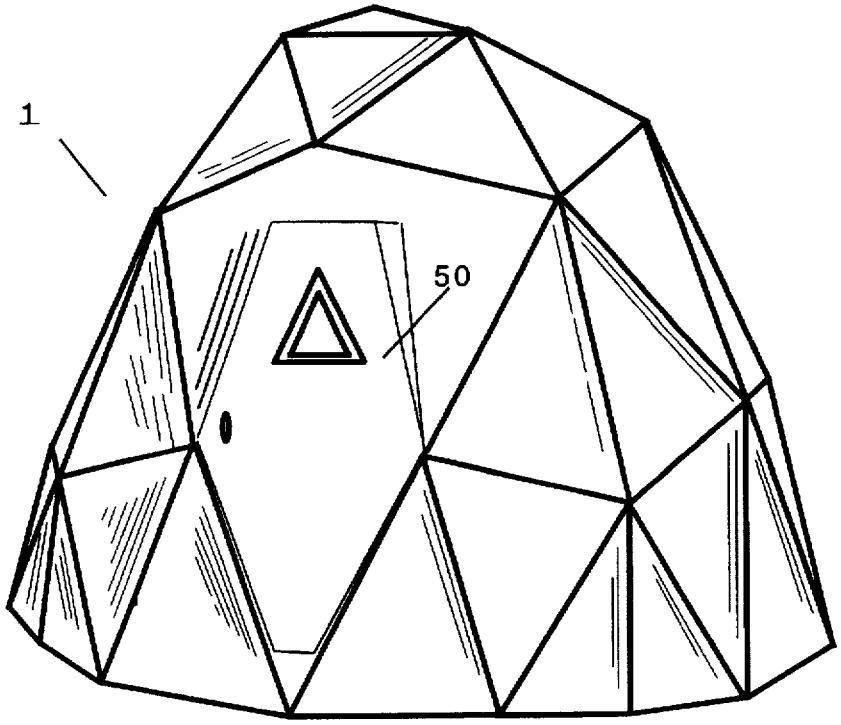
FIG. 1 is a perspective view of the invention, showing the door and a typical window.

Reviewing dome construction literature, dome design is focused on the framing members and their geometry. Layout of these members can be done using trigonometry and some basic formulas. As discussed above, the majority of the prior art uses individual frame members to form the dome structure. These members are then covered with a suitable covering. The instant design eliminates the need for numerous framing parts and a separate covering material to construct a dome. Referring now to FIG. 1, a circular dome 1 is shown. In this configuration, the dome has a floor 2 made from floor panels 40 (see FIGS. 6, 7, and 19), and four quarter panels 4. The dome has a door 50 as shown. Windows 51 (see, e.g., FIG. 3) can be included if desired. The dome 1 is designed to be transportable in or on small aircraft to remote locations. The dome 1 is built from quarter panel sections 4 that are made up of smaller panel pieces. Each of these sub pieces is discussed below.

Figure 2:
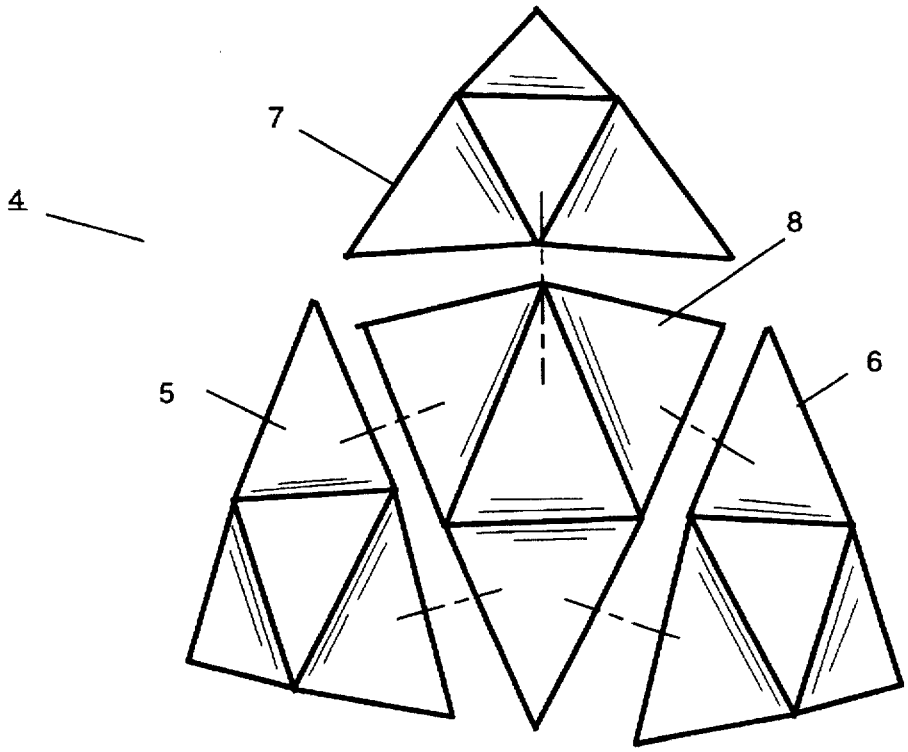
FIG. 2 is an exploded view of a typical quarter wall section (in this view no flanges are shown).
Figure 3:
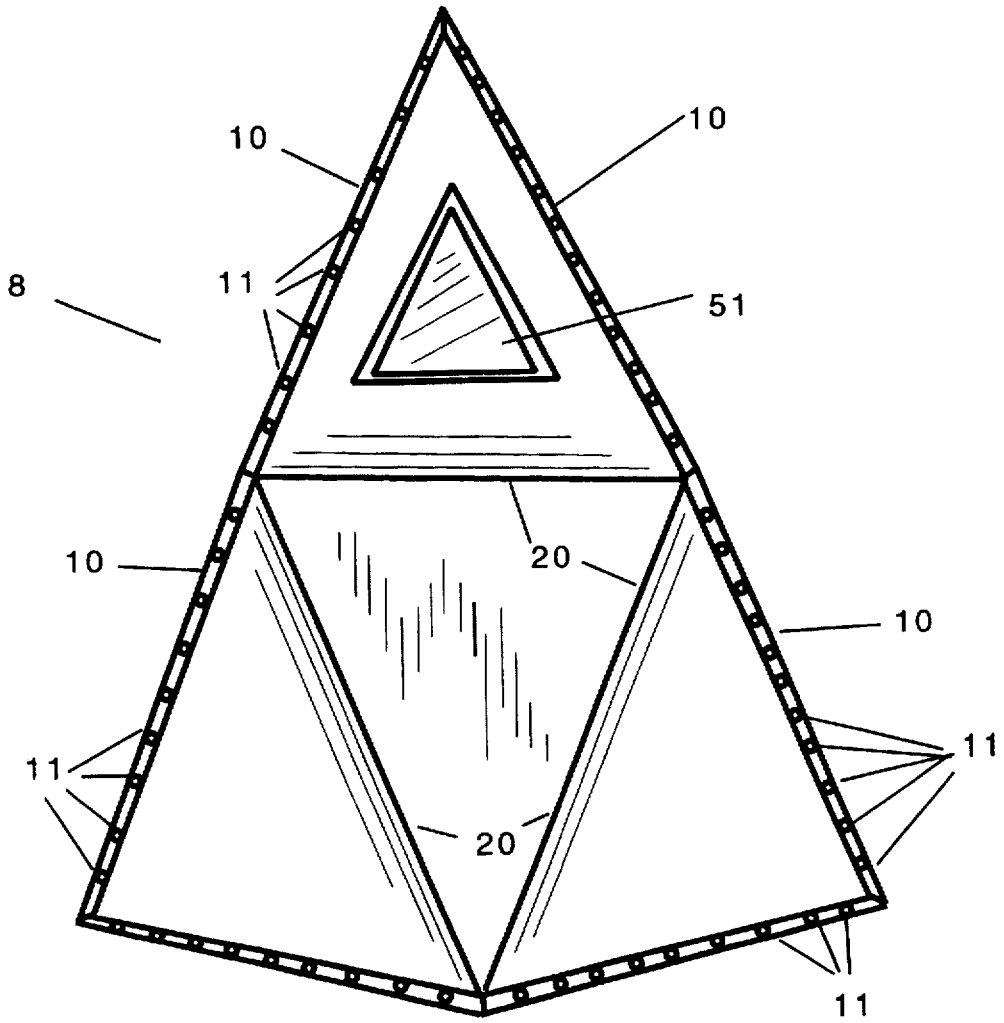
FIG. 3 is a detail view of the center portion of the quarter wall.
Figure 4A:
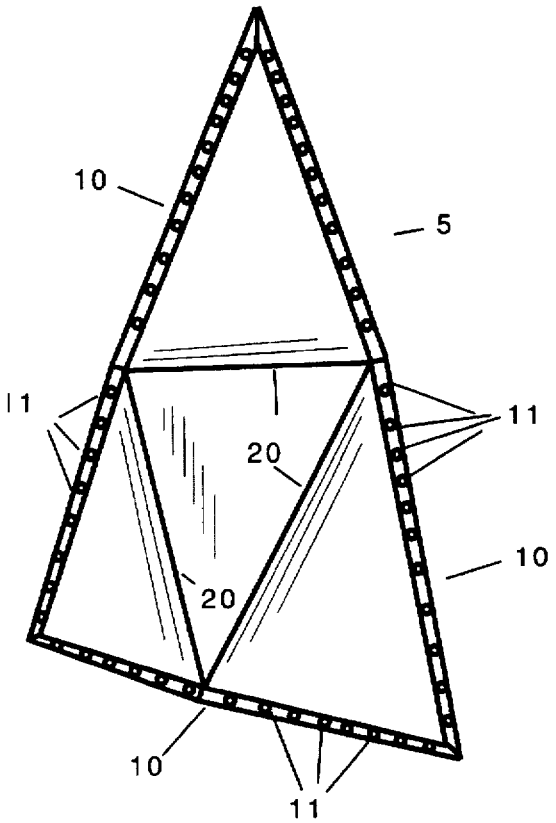
FIG. 4*a* is a detail view of the left panel of the quarter wall.
Figure 4B:
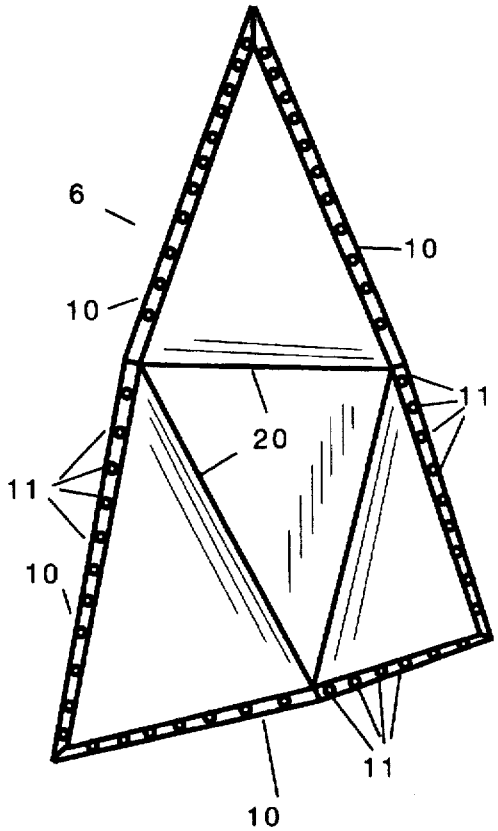
FIG. 4*b* is a detail view of the right panel of the quarter wall.
Figure 5:
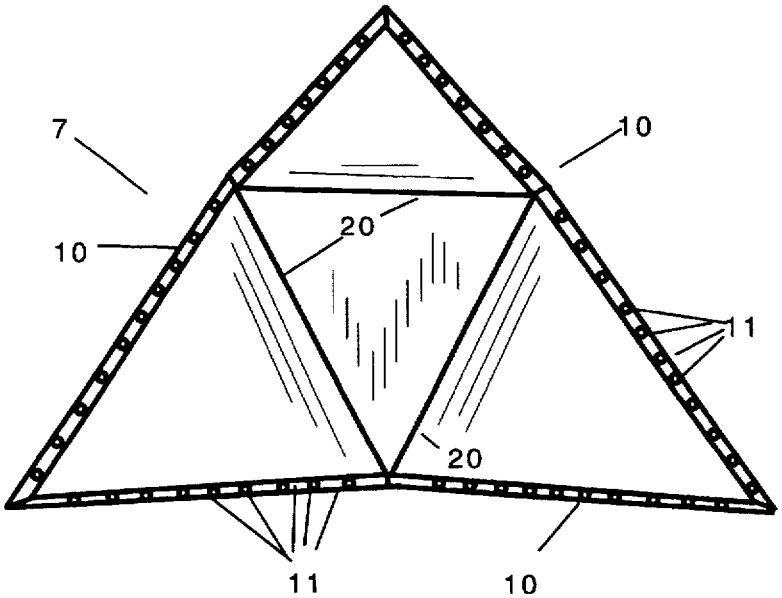
FIG. 5 is a detail view of the top portion of the quarter wall.
Figure 6:
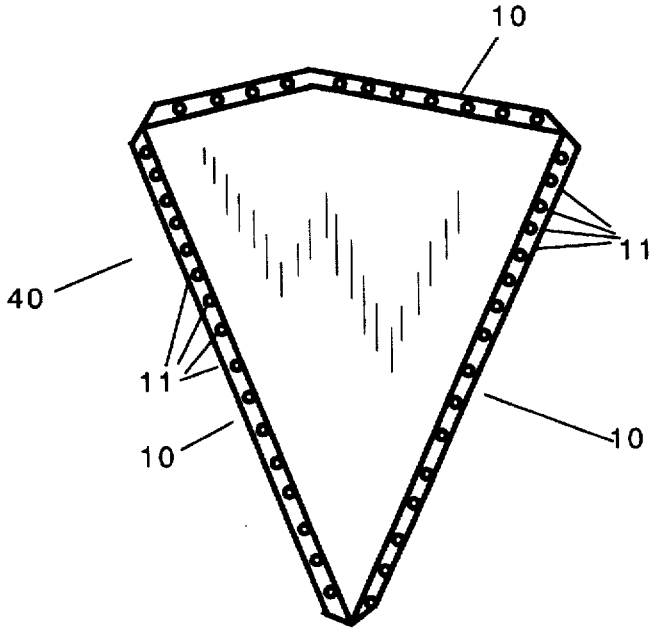
FIG. 6 is a top view of a typical floor section.
Figure 13:
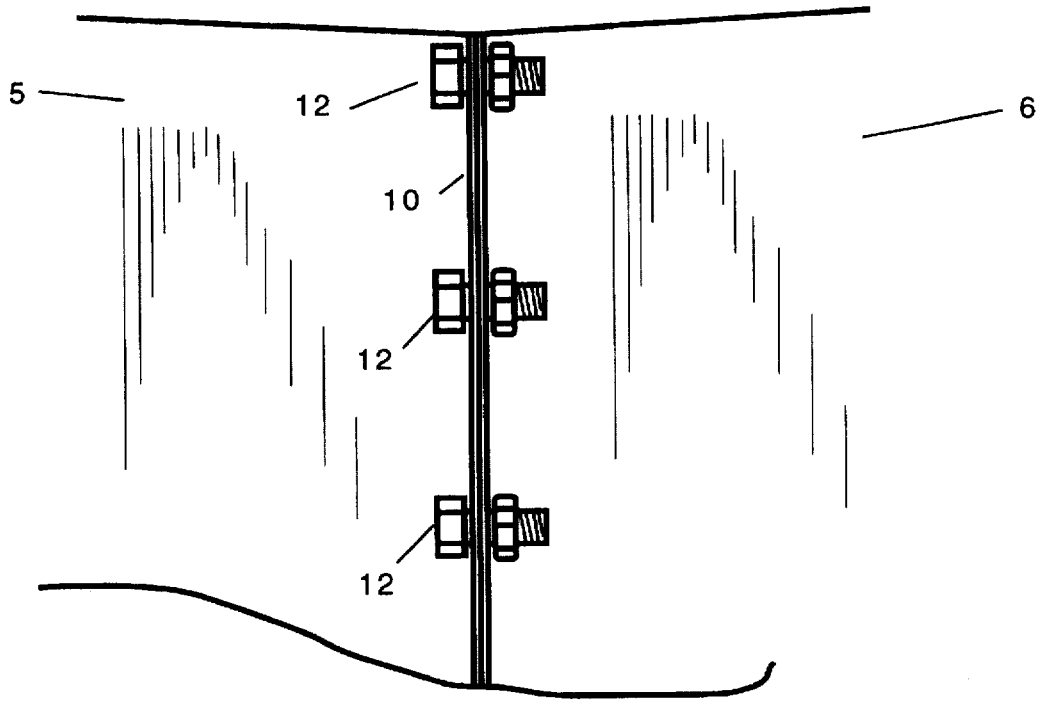
FIG. 13 is a rear detail view of the flanges as assembled.
Figure 14:
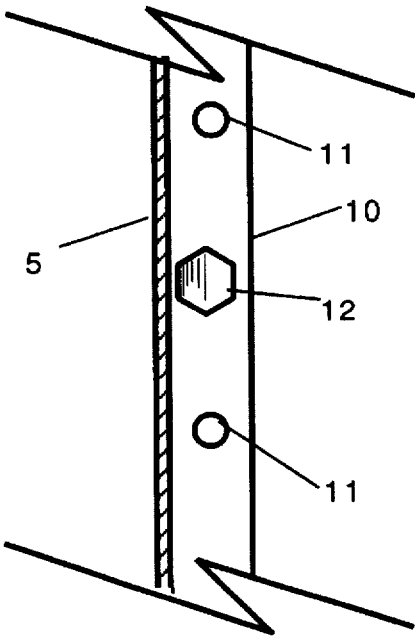
FIG. 14 is a side detail view of the flanges as assembled.

Referring now to FIG. 2 a typical quarter panel 4 is shown in exploded form. Each quarter panel 4 is made up of four sub panels. A center subpanel 8 is shown in FIG. 3. FIG. 4*a* shows the left side sub panel 5. The right side sub panel 6 is a mirror image of sub panel 5, and is shown in FIG. 4*b*. The top panel section 7 is shown in FIG. 5. The floor sub panel 40 is shown in FIG. 6. Each of the sub panels shown in FIGS. 3–6 have flanges 10 formed about their edges as shown. The flanges are used to bolt the sub panels together to form a quarter panel and then to bolt the quarter panels together (see FIGS. 13 and 14). Bolt holes 11 are provided in the flanges 10, to bolt the flanges 10 together using bolts 12. Note that the flanges as shown in the drawings are not in the assembled position. The flanges 10 are typically bent back to allow for assembly as shown in FIGS. 13 and 14. The flanges 10 are on the drawings as shown to illustrate the placement of the flanges 10 about the perimeters of the wall sections.

Once assembled, the wall section seams can be coated with silicone sealer, or a similar type product. This sealer closes the seams and makes the dome watertight. Moreover, the sealer can be removed with a razor knife, or similar implement when the dome is to be moved.

Each sub panel is creased about a number of creases or fold lines 20 as shown. The fold lines 20 create the necessary angles to allow the subsections to fit together to form quarter sections that abut at right angles. The ability of these quarter sections to abut at right angles is a very useful feature because it allows the dome 1 to be divided to insert rectangular extension pieces, which are discussed below. The angles of the fold lines 20 are called dihedral angles. Calculating the dihedral angles can be done using well know mathematics available in the many dome books now available, such as the Dome Book II, 1971, or Geodesics, by E. Popko, 1972. Although these calculations can be done, an alternative method of determining these angles is building a small scale model of the desired dome. For an elliptical dome, for example, the pieces can be cut using the FIGS. 2 through 5. The pieces can then be assembled into quarter sections, forming a spherical dome. The pieces can be creased on the fold lines 20 as needed to get the desired structure. To produce a new pattern, determine the type of structure desired, then determine the chord lengths using the techniques described in the references above. Once the chord lengths are known, draw out the structure using a compass to find the angle vertices. Then, cut out the pieces and tape them together, making the appropriate creases as needed. Then dihedral angles (and any other angles on the structure) thus formed can be measured and read using a bevel tool and protractors. This process can be done relatively quickly and produces reliable results that can be translated to the full size dome. The model method of determining the angles is also preferred because it can be adapted for different size domes or configurations.

Figure 17:
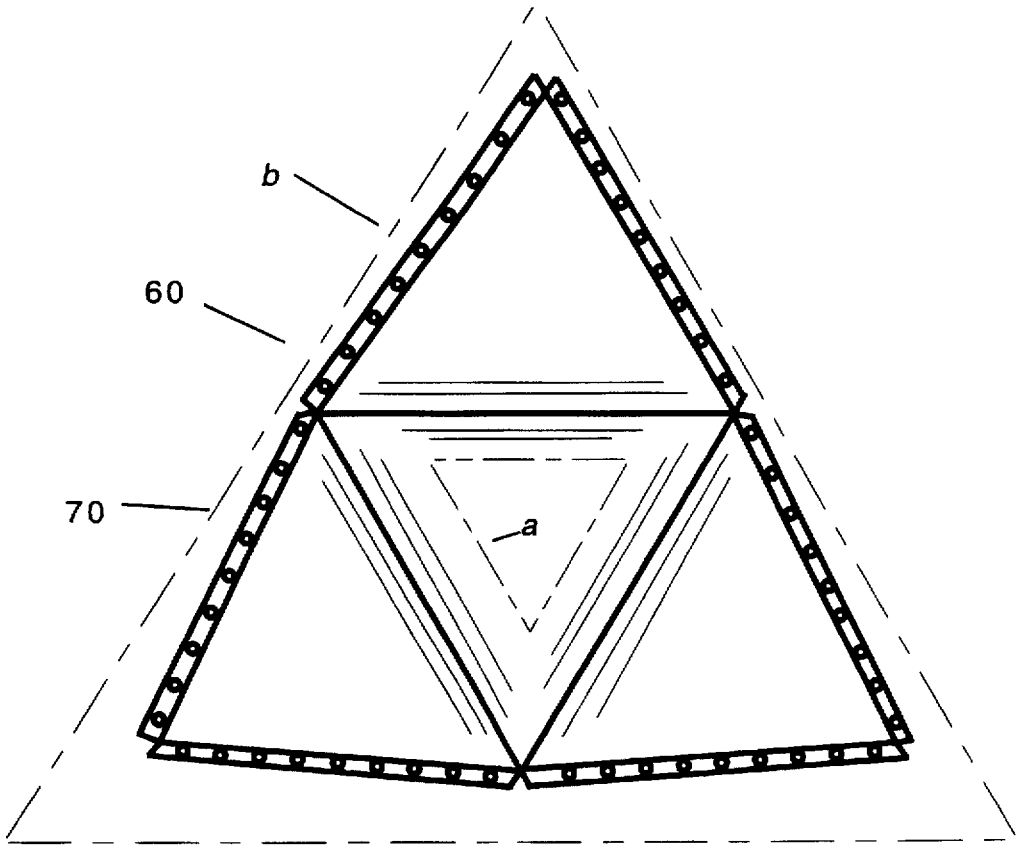
FIG. 17 is a detail view of a section of a spherical 2V icosahedron dome using the techniques of the instant invention.

As discussed above, the various Dome books provide the basic geometric forms needed for dome construction. This invention utilizes those forms in two unique ways. First, the idea of forming bent panels for dome construction eliminates the need for complex framing. This technique can be applied to most dome structures. FIG. 17, for example, shows a panel 60 for a 2V Icosahedron that uses fifteen of the panels 60 to form a spherical dome. As in the case of the preferred embodiment, each panel 60 has formed fold lines, or creases 20 that conform to the requirements for that particular dome. The panels also have flanges 70 as shown, to allow for bolt together assembly, as discussed above. Looking at the sub panels in either embodiment, the creases 20 are positioned to form a structure based on the form of a triangle within a triangle. See FIG. 17, for example. The inner triangle a is surrounded by the larger outer triangle b. This structure provides for a strong but lightweight configuration.

The second unique feature of this geometry (not including that of the 2V icosahedron) is that the quarter panels 4 are designed to have right angles at there assembled outer edges. This allows the use of rectangular extension pieces, as discussed below, to expand the dome as desired.

The subpanels, 5, 6, 7, and 8, have flanges 10 formed around the perimeter of each subpanel. FIGS. 13 and 14 show details of these flanges 10. The flanges 10 have a number of holes 11 formed in them to receive bolts 12. Thus, the sub panels 5, 6, 7, and 8, are aligned and bolted together using the flanges 10 as shown in FIG. 13. Once these subpanels 5, 6, 7, and 8, are bolted together, a quarter section 4 is formed. Each quarter section 4 has a flange 10 running about its perimeter. This flange 10 is the unused portion of the outer subpanel flanges 10. The quarter sections 4 can then be bolted together using the outer perimeter flanges 10.

Figure 7:
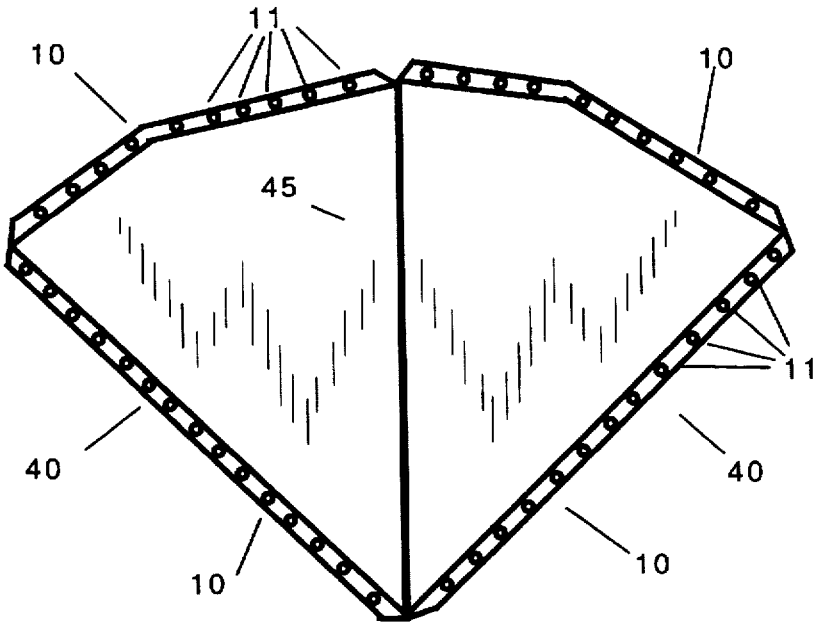
FIG. 7 is a top view of a quarter-floor section.
Figure 19:
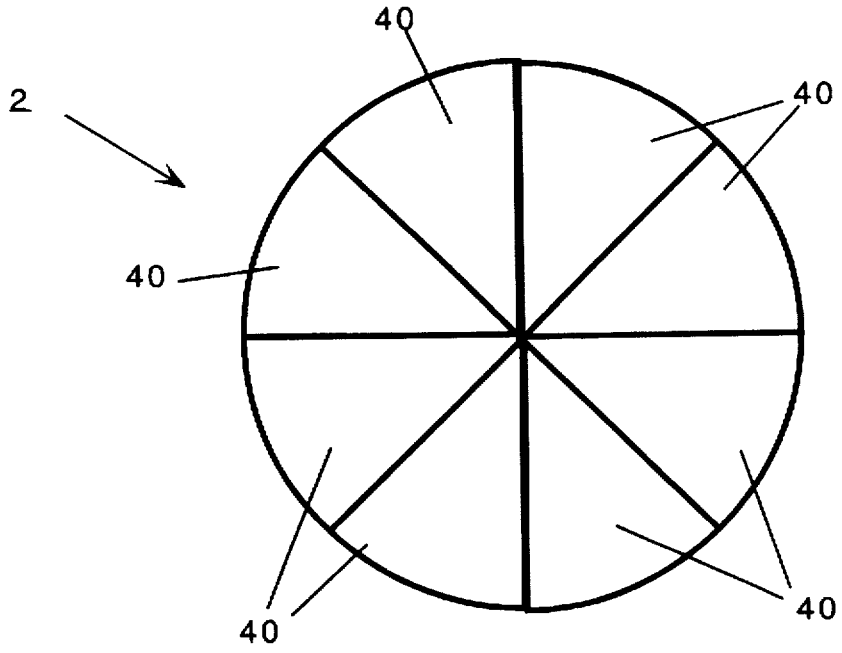
FIG. 19 is a top plan view of the floor showing the floor panels connected.

Referring now to FIGS. 6 and 7, 19 the floor 2 bolts together in many sections in a similar manner as the side walls. The floor sections 40 are fitted with flanges 10 to allow the sections to bolt together, just like the wall sections. Two floor sections 40 are needed to make a one-quarter section of the floor 45, as shown in FIG. 7. Therefore, eight floor sections 40 are needed to make one circular floor 2, as shown in FIG. 19. Like the side walls, the quarter sections 45 of the floor 2 can be divided along straight lines. This allows rectangular pieces to be added to the floor 2 to expand the unit, as discussed below.

Figure 8:
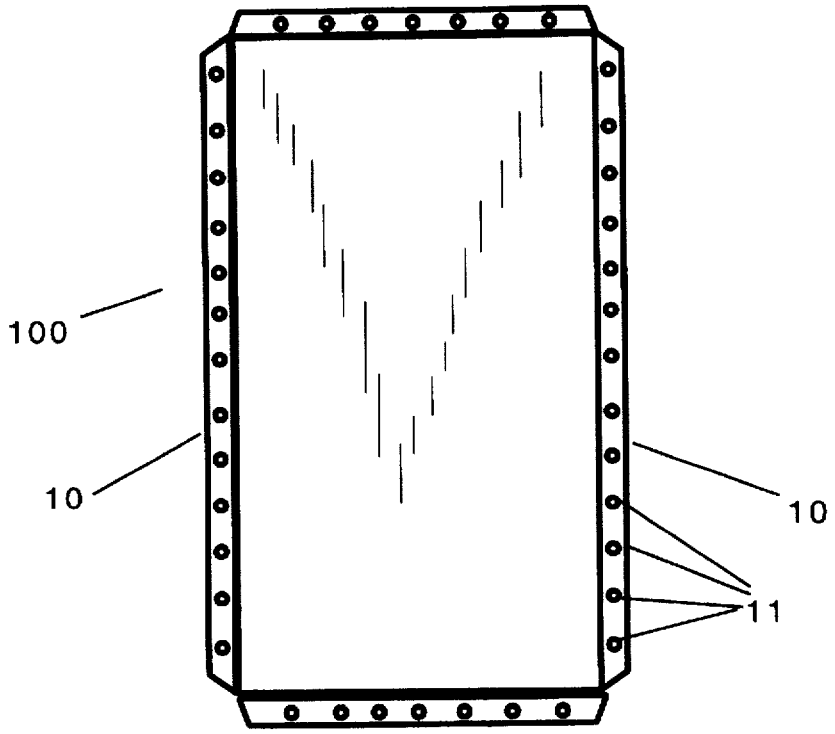
FIG. 8 is a top view of a rectangular wall section.
Figure 9:
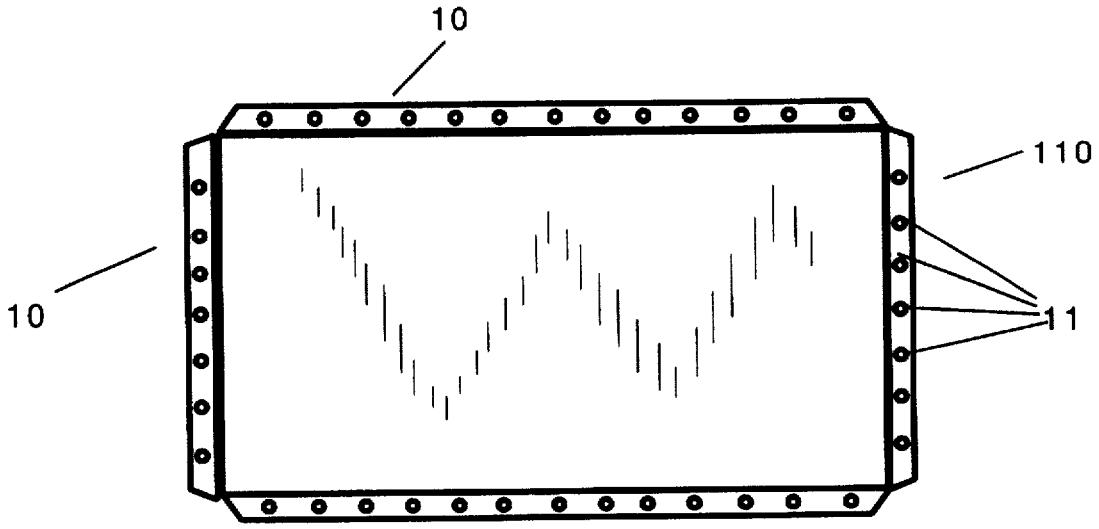
FIG. 9 is a top view of a rectangular floor section.
Figure 10:
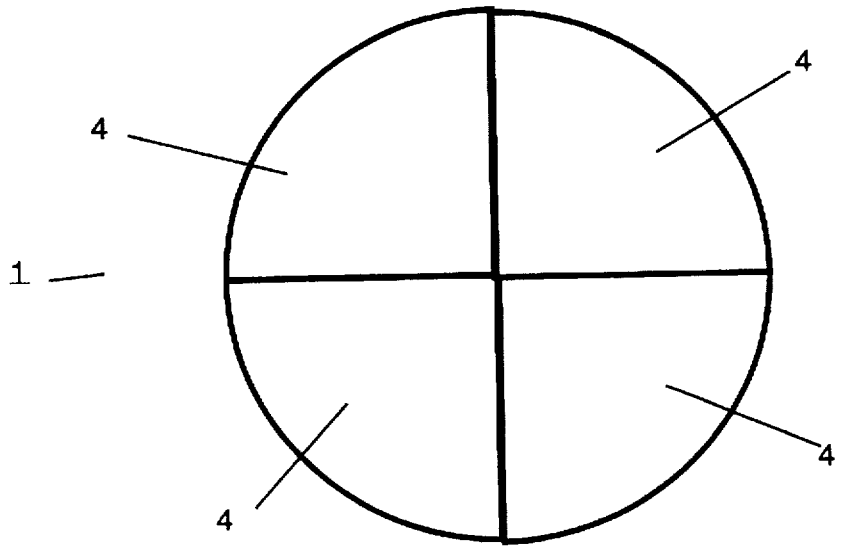
FIG. 10 is a top representational view showing the assembly of a circular dome out of quarter panel sections.
Figure 11:
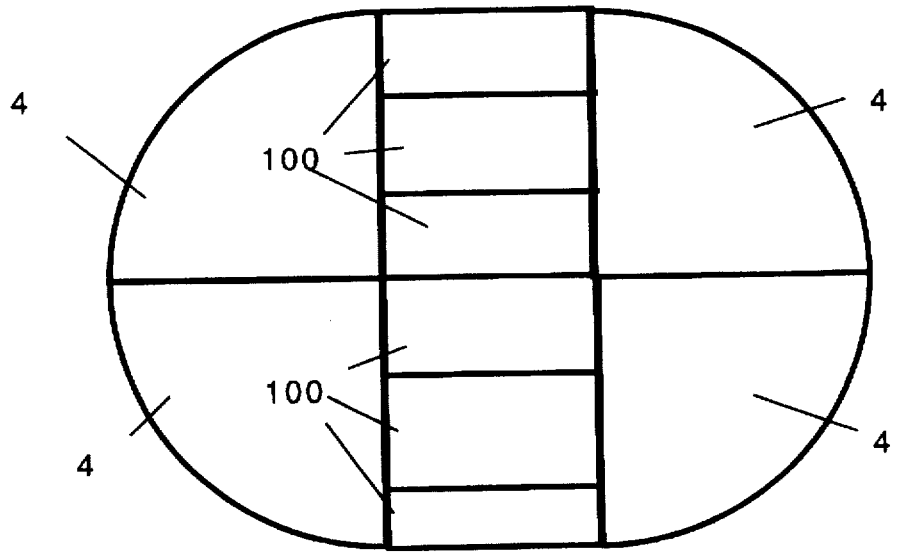
FIG. 11 is a top representational view of a first elliptical dome using one rectangular expansion member.
Figure 12:
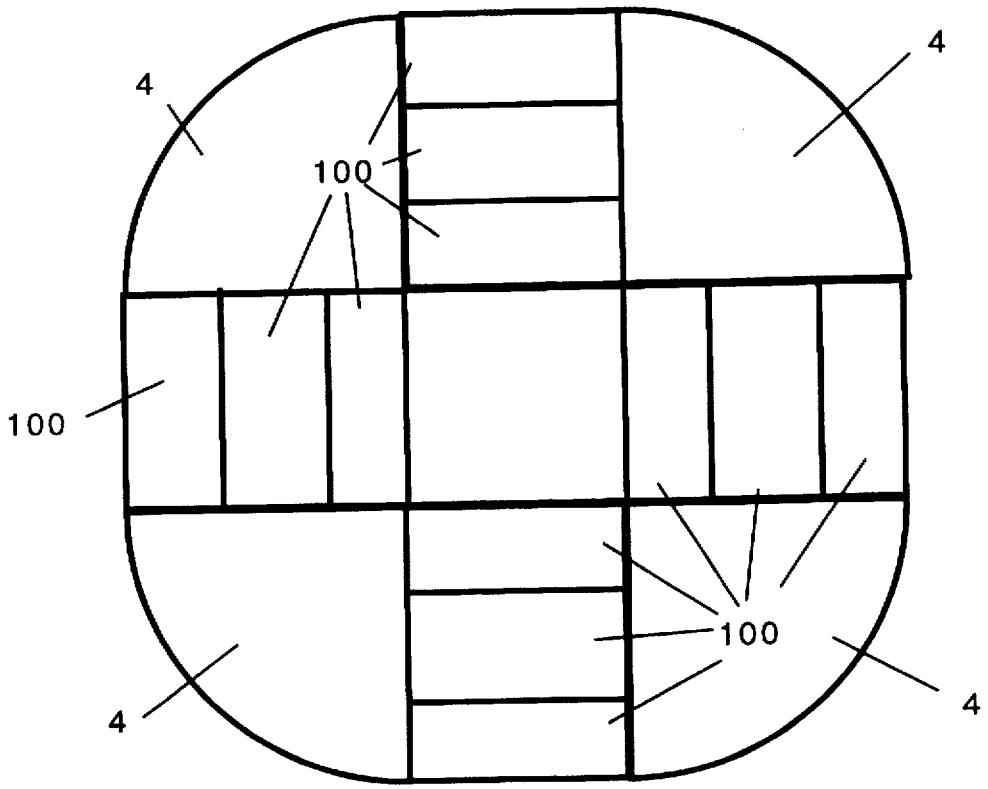
FIG. 12 is a top representational view of a second elliptical dome using two rectangular expansion members.

FIGS. 10–12 show diagrammatic top views of a circular dome (as shown in FIG. 1) and extended elliptical domes. FIG. 10 shows the dome having four quarter sections bolted together to form a circular dome FIG. 11 shows the same with one set of extensions 100 for the walls. The extensions divide the dome along one diameter, creating an elliptical structure as shown. FIG. 12 shows the dome with a second set of extensions 100. These sections are bolted along the minor axis of the ellipse, further expanding the size of the unit. To expand the circular dome, the rectangular sections are simply bolted to the quarter panels to make the new dome structure. As the dome is expanded, the floor must also be expanded using rectangular extensions 110. These extensions 110, are attached in the same manner as the extensions for the walls. FIGS. 8 and 9 show the rectangular sections 100 for the walls 110 and 110 for the floor 110. Each extension has a rectangular body that has a set of flanges 10 about the perimeter. The flanges 10 have bolt holes 11 to permit the sections to be bolted together as the walls and floor are connected.

Figure 15:
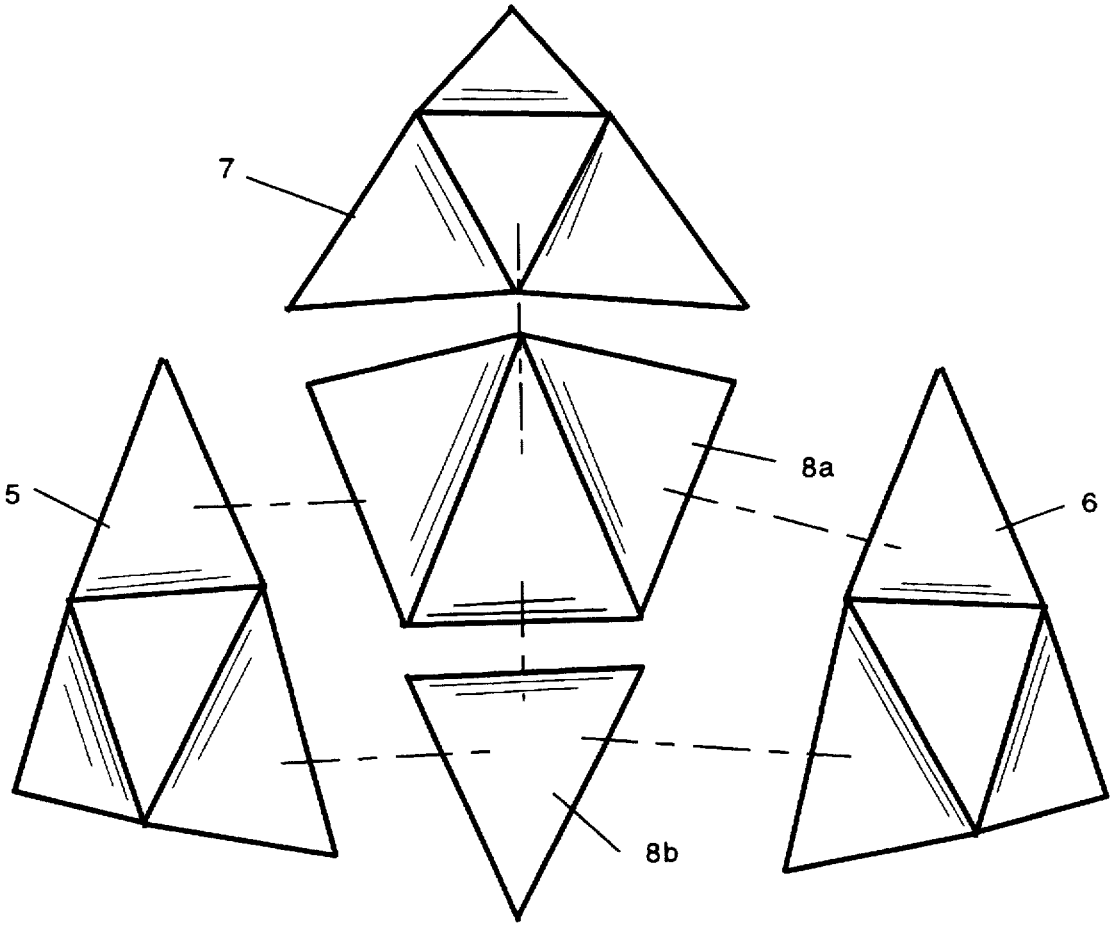
FIG. 15 is an exploded view of a typical quarter wall section with the center section being split (in this view no flanges are shown).
Figure 16:
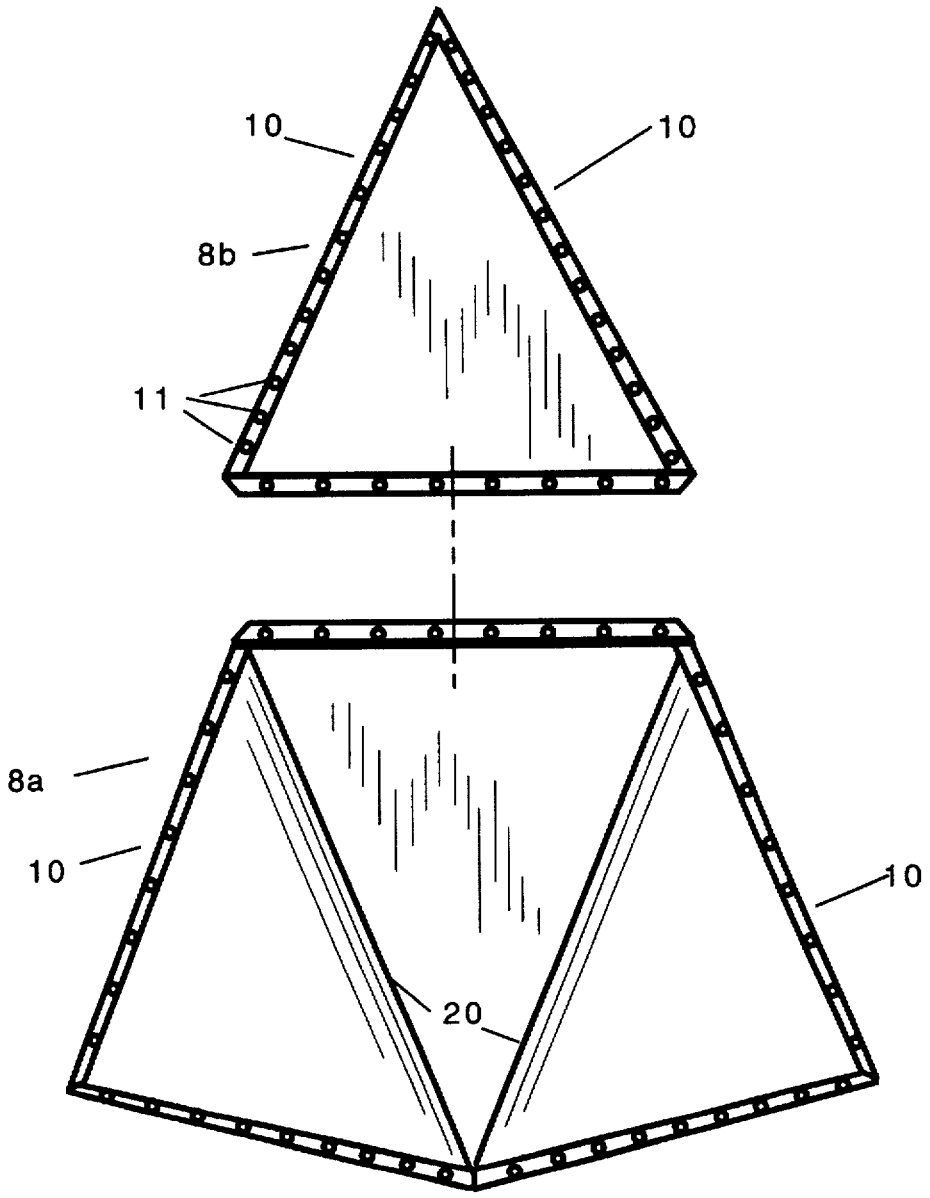
FIG. 16 is a detail view of the center portion of the quarter wall having a split in the structure.

FIGS. 15 and 16 are details of a second embodiment of the dome. Here, the center panel 8 is split as shown, into parts 8*a* and 8*b* as shown. This allows the all the sub panels 5, 6, 7, 8*a* and 8*b* to fit within a small single engine plane such a Cessena 206. Dome assembly in this embodiment is the same, with only some additional bolting required to rejoin the center panels, using an extra set of flanges 10 and bolts 12 as shown.

Figure 18:
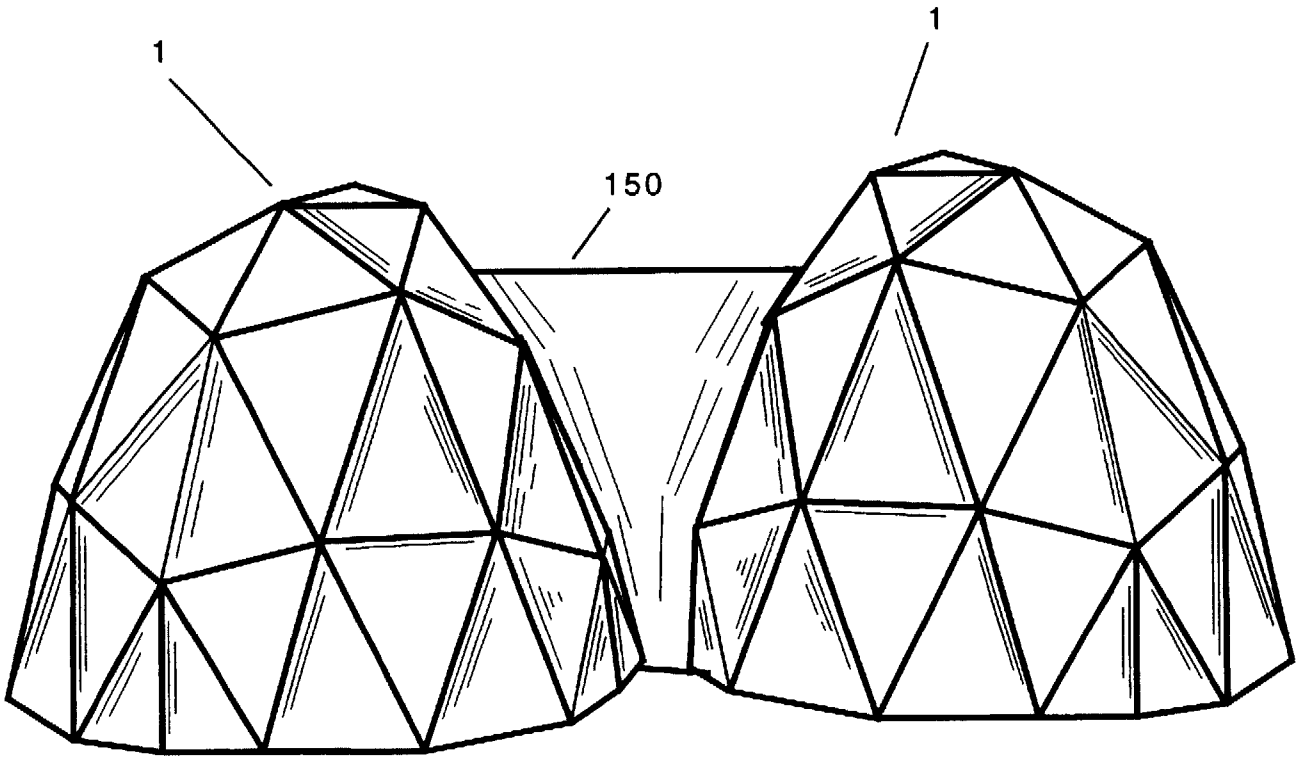
FIG. 18 is a side view of two domes joined by a breezeway module.

Finally, FIG. 18 is a side view of two domes 1 connected by a breezeway 150. The domes 1 must have at least one set of extension units 100 and 110, as shown in FIGS. 11 or 12. The breezeway 150 replaces an expansion piece 100. The uppermost expansion piece 100 is modified by cutting a space in it and then attaching a ridge line to form the breezeway 150. The external side walls complete the breezeway as shown in the drawing. In this way, two units can be connected to allow passage between them out of the weather. Also, because the breezeway 150 is formed from extension pieces, the entry doors are not blocked.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A portable geodesic dome building, having a perimeter, comprising:

a) a plurality of floor sections, removably connected to form a uniform floor surface;

b) means for connecting said plurality of floor sections together;

c) a plurality of individual wall sections, each individual wall section including a plurality of sub wall sections, removably connected together, to form each individual wall section; each sub wall section being formed of a single piece of material and each sub wall section having a plurality of permanent creases formed therein, said creases being chord lengths of a geodesic dome and further such that said creases create a dihedral angle within each sub wall section;

d) means for connecting said plurality of sub wall sections together;

e) means for connecting said plurality of individual wall sections together; and f) means for attaching said plurality of individual wall sections to said plurality of floor sections.

2. The portable geodesic dome building of claim 1 wherein said plurality individual wall sections form a circular perimeter.

3. The portable geodesic dome building of claim 1 wherein said plurality of individual wall sections form 4 quarter sections.

4. The portable geodesic dome building of claim 1 wherein each individual wall section includes four sub wall sections.

5. The portable geodesic dome building of claim 1 wherein each individual wall section includes five sub wall sections.

6. The portable geodesic dome building of claim 1 wherein the means for connecting said plurality of individual wall sections, said plurality of sub wall sections and said plurality of floor sections together comprise:

a) a plurality of flanges fixedly attached to said plurality of individual wall sections, said plurality of sub wall sections and said plurality of floor sections, such that when said plurality of individual wall sections, said plurality of sub wall sections and said plurality of floor sections are assembled, said plurality of flanges are in substantial alignment; and b) fastening means for securing said plurality of flanges together.

7. The portable geodesic dome building of claim 1 further comprising:

a) a set of rectangular wall extension pieces, removably connected between said plurality of individual wall sections whereby said set of rectangular wall extension pieces are coplanar with said plurality of individual wall sections; and b) a corresponding set of rectangular floor extension pieces, removably connected between said plurality of floor sections such that said set of rectangular wall extension pieces and said set of rectangular floor extension pieces are in spatial alignment, thereby causing the perimeter of said portable geodesic dome building to be expanded along a first axis.

8. The portable geodesic dome building of claim 7 further comprising:

a) a second set of rectangular wall extension pieces, removably connected between said plurality of individual wall sections whereby said second set of rectangular wall extension pieces are coplanar with said plurality of individual wall sections; and b) a second corresponding set of rectangular floor extension pieces, removably connected between said plurality of floor sections such that said second set of rectangular wall extension pieces and said second set of rectangular floor extension pieces are in spatial alignment, thereby causing the perimeter of said portable geodesic dome building to be expanded along a second axis.

9. A portable geodesic dome building, having a perimeter, comprising:

a) a plurality of floor sections, removably connected to form a uniform floor surface;

b) means for connecting said plurality of floor sections together;

c) four quarter wall sections, being removably connected, each quarter wall section including a plurality of sub wall sections, removably connected together, to form each quarter wall; each sub wall section being formed of a single piece of material and each sub wall section having a plurality of permanent creases formed therein, whereby said plurality of permanent creases are chord lengths of a geodesic dome and further said plurality of creases create a dihedral angle within each sub wall section;

d) means for connecting said plurality of sub wall sections together;

e) means for connecting said quarter wall sections together; and f) means for attaching said quarter wall sections to said plurality of floor sections.

10. The portable geodesic dome building of claim 9 wherein said four quarter wall sections form a circular perimeter when connected.

11. The portable geodesic dome building of claim 9 wherein each individual wall section includes four sub wall sections.

12. The portable geodesic dome building of claim 9 wherein each individual wall section includes five sub wall sections.

13. The portable geodesic dome building of claim 9 wherein said means for connecting said quarter wall sections, said plurality of sub wall sections and said plurality of floor sections together comprise:

a) a plurality of flanges fixedly attached to said quarter wall sections, said plurality of sub wall sections and said plurality of floor sections, such that when said quarter wall sections, said plurality of sub wall sections and said plurality of floor sections are assembled, said plurality of flanges are in substantial alignment; and b) fastening means for securing said plurality of flanges together.

14. The portable geodesic dome building of claim 10 further comprising:

a) a set of rectangular wall extension pieces, removably connected between said quarter wall sections whereby said set of rectangular wall extension pieces are coplanar with said plurality of individual wall sections; and b) a corresponding set of rectangular floor extension pieces, removably connected between said plurality of floor sections such that said set of rectangular wall extension pieces and said set of rectangular floor extension pieces are in spatial alignment, thereby causing the perimeter of said portable geodesic dome building to be expanded along a first axis.

15. The portable geodesic dome building of claim 14 further comprising:

a) a second set of rectangular wall extension pieces, removably connected between said quarter wall sections whereby said second set of rectangular wall extension pieces are coplanar with said plurality of individual wall sections; and b) a second corresponding set of rectangular floor extension pieces, removably connected between said plurality of floor sections such that said second set of rectangular wall extension pieces and said second set of rectangular floor extension pieces are in spatial alignment, thereby causing the perimeter of said portable geodesic dome building to be expanded along a second axis.

16. A portable geodesic dome building, having a perimeter, comprising:

a) a plurality of floor sections, removably connected to form a uniform floor surface, each floor section also having a perimeter and each floor section having a plurality of flanges fixedly attached to said perimeter;

b) four quarter wall sections, including a plurality of sub wall sections, removably connected to form each quarter wall section, each sub wall section being formed of a single piece of material and each sub wall section having a plurality of permanent creases formed therein, whereby said plurality of permanent creases are chord lengths of a geodesic dome and further said plurality of creases create a dihedral angle within each sub wall section, each sub wall section also having a perimeter and having a plurality of flanges fixedly attached to said perimeter;

c) means for connecting said plurality of sub walls together;

d) means for connecting said quarter wall sections together;

e) means for connecting said plurality of floor sections together; and f) means for connecting said quarter wall sections to said plurality of floor sections.

17. The portable geodesic dome building of claim 16 further comprising:

a) a set of rectangular wall extension pieces, removably connected between said quarter wall sections whereby said set of rectangular wall extension pieces are coplanar with said plurality of individual wall sections; and b) a corresponding set of rectangular floor extension pieces, removably connected between said plurality of floor sections such that said set of rectangular wall extension pieces and said set of rectangular floor extension pieces are in spatial alignment, thereby causing the perimeter of said portable geodesic dome building to be expanded along a first axis.

18. The portable geodesic dome building of claim 17 further comprising:

a) a second set of rectangular wall extension pieces, removably connected between said quarter wall sections whereby said second set of rectangular wall extension pieces are coplanar with said plurality of individual wall sections; and b) a second corresponding set of rectangular floor extension pieces, removably connected between said plurality of floor sections such that said second set of rectangular wall extension pieces and said second set of rectangular floor extension pieces are in spatial alignment, thereby causing the perimeter of said portable geodesic dome building to be expanded along a second axis.

19. The portable geodesic dome building of claim 16 further comprising: a door, fixedly attached to said portable geodesic dome building.

* * * * *